US009901921B2

(12) United States Patent
Wright

(10) Patent No.: US 9,901,921 B2
(45) Date of Patent: Feb. 27, 2018

(54) DISPOSABLE INVITRO DIAGNOSTIC CARTRIDGE AND METHOD OF PERFORMING AN INVITRO DIAGNOSTIC TEST

(71) Applicant: David W. Wright, Littleton, CO (US)

(72) Inventor: David W. Wright, Littleton, CO (US)

( * ) Notice: Subject to any disclaimer, the term of this patent is extended or adjusted under 35 U.S.C. 154(b) by 24 days.

(21) Appl. No.: 15/169,414

(22) Filed: May 31, 2016

(65) Prior Publication Data

US 2016/0346778 A1 Dec. 1, 2016

Related U.S. Application Data

(60) Provisional application No. 62/167,481, filed on May 28, 2015.

(51) Int. Cl.
*B01L 3/00* (2006.01)
*B01F 11/00* (2006.01)

(52) U.S. Cl.
CPC ..... *B01L 3/502* (2013.01); *B01F 11/0048* (2013.01); *B01L 2200/0621* (2013.01); *B01L 2200/10* (2013.01); *B01L 2200/14* (2013.01); *B01L 2300/043* (2013.01); *B01L 2300/0627* (2013.01); *B01L 2300/087* (2013.01); *B01L 2300/0867* (2013.01); *B01L 2300/0887* (2013.01); *B01L 2400/0481* (2013.01); *B01L 2400/0638* (2013.01)

(58) Field of Classification Search
CPC ..... B01L 2200/16; B01L 2300/0816; B01L 2400/0683; B01L 2300/044; B01L 2400/0633; B01L 2200/10; B01L 2300/123; B01L 2300/1877; B01L 2400/0481; B01L 2400/0661; B01L 3/5027; B01L 2200/0621; B01L 2300/047; B01L 2300/0672; B01L 2300/0867; B01L 2400/0638; B01L 3/502738; A61B 2562/0295
See application file for complete search history.

(56) References Cited

U.S. PATENT DOCUMENTS

2015/0321193 A1* 11/2015 Sprague ..... F04B 19/006 422/505
2016/0129437 A1* 5/2016 Kayyem ..... B01L 3/502 204/600
2017/0173585 A1* 6/2017 Mahony ..... B01L 7/52

* cited by examiner

*Primary Examiner* — Sally A Merkling
(74) *Attorney, Agent, or Firm* — John D. Wright; Dickinson Wright PLLC

(57) ABSTRACT

A disposable, point-of-care diagnostic cartridge and method of performing an invitro diagnostic test on a specimen are provided. The cartridge includes a base having a mixing chamber is formed thereon. The mixing chamber has a mixing chamber inlet and a mixing chamber outlet. A detection chamber is formed downstream from the mixing chamber in fluid communication therewith. The mixing chamber includes a mixing reservoir bounded at least in part by a flexible upper member. The flexible upper member is expandable to accommodate an increase in volume of fluid and collapsible to dispense fluid outwardly from the mixing reservoir. The mixing chamber inlet has an inlet valve member that provides one way flow of fluid into the mixing reservoir. The mixing chamber outlet has an outlet valve member that provides one way flow of fluid outwardly from the mixing reservoir to the detection chamber.

7 Claims, 6 Drawing Sheets

DISPOSABLE INVITRO DIAGNOSTIC CARTRIDGE AND METHOD OF PERFORMING AN INVITRO DIAGNOSTIC TEST

CROSS-REFERENCE TO RELATED APPLICATION

This application claims the benefit of U.S. Provisional Application Ser. No. 62/167,481, filed May 28, 2015, which is incorporated herein by reference in its entirety.

BACKGROUND

1. Technical Field

This invention relates generally to invitro diagnostics, and more particularly to disposable invitro diagnostic cartridges and methods of performing invitro diagnostic tests.

2. Related Art

Diagnostic tests are increasingly being used to determine the state or condition of a biological environment, such as in human healthcare, agriculture, live stock management, municipal systems management, and national defense, by way of example and without limitation. A new market is emerging wherein diagnostic tests are being performed at the point-of-care. The diagnostic test can be complex, requiring multiple fluids and multiple steps to execute an assay. An assay is a sequence of steps or procedures used measure the presence or absence of a substance in a sample, the amount of a substance in a sample, or the characteristics of a sample. An example of a common and relative simple point-of-care assay, which can be readily conducted by a layperson, is a blood glucose test. In this test, generally speaking, the blood is mixed with glucose oxidase, which reacts with the glucose in the sample, creating gluconic acid, wherein the gluconic acid reacts with a chemical, typically ferricyanide, producing ferrocyanide. Current is passed through the ferrocyanide and the impedance reflects the amount of glucose present.

Although the aforementioned blood glucose assay is relative common and simple, many assays are far more complex, in that they require specific fluids, often of differing types and quantities, to be stored for future use on the diagnostic device. These fluids may be, but are not limited to, a buffer solution for dilution, fluids containing antibodies and antigens, microspheres coated with binding agents, cell lysing agents, and other fluids required to manipulate the sample being tested. Diagnostic tests that utilize millifluidic and microfluidic volumes of the fluids are intended to provide an incredibly high degree of specificity, sensitivity, and a precise volume and rate of fluid delivery to achieve as accurate a test result as possible. Nearly all microfluidic tests require the introduction of fluids throughout the assay sequence to manipulate the sample being tested and to produce an accurate diagnosis.

Typically, consumable diagnostic devices, meaning the diagnostic device is disposable upon being used, require a companion durable hardware device that interfaces with the consumable diagnostic device to execute the test. The durable hardware performs many functions, one of which is to facilitate dispensing a reagent in a reservoir or reagents from separate reservoirs on the consumable diagnostic into a specimen containing reaction chamber via microfluidic or millifluidic channels formed within the consumable diagnostic device. The introduction of the reagent into the reaction chamber requires precision; including flow rate, volume and timing, so as to best replicate the protocols of a laboratory where precession pipettes are employed. Upon the reagent being introduced into the reaction chamber, the reagent and specimen are generally kept in the reaction chamber for a minimum specified amount of time to allow the sample to mix as best possible with the reagent. Further, it is known to incorporate a mixing apparatus within the reaction chamber to further mix the specimen and the reagent prior to performing the analysis. The incorporation of a mixing member within the reaction chamber adds complexity, which can lead to error in test results, and further adds cost to the construction of the diagnostic device. Further yet, the mixing member can result in the specimen being over diluted, thereby resulting in volumetric loss of the specimen, and thus, resulting in a less than optimal, or failed test result.

SUMMARY OF THE INVENTION

In accordance with one aspect of the invention, a disposable, point-of-care diagnostic cartridge is provided. The cartridge includes a rigid base having opposite upper and lower surfaces. A mixing chamber is formed on the base. The mixing chamber has at least one mixing chamber inlet and a mixing chamber outlet. A detection chamber is formed on the base downstream from the mixing chamber. A fluidic channel extends in fluid communication between and with the mixing chamber and the detection chamber via the mixing chamber outlet and a detection chamber inlet. The mixing chamber includes mixing reservoir bounded at least in part by a flexible upper member operably fixed to the upper surface of the base. The flexible upper member is expandable to increase the volume of the mixing reservoir and collapsible to decrease the volume of the mixing reservoir. Each mixing chamber inlet has an inlet valve member that provides one way flow of fluid into the mixing reservoir and prevents fluid from flowing in a reverse direction outwardly from the mixing reservoir. The mixing chamber outlet has an outlet valve member that provides one way flow of fluid outwardly from the mixing reservoir to the detection chamber and prevents fluid from flowing in a reverse direction into the mixing reservoir. The inlet valve member opens while a liquid is selectively injected through the mixing chamber inlet, thereby causing the flexible upper member to expand and form a raised blister, whereupon the inlet valve member automatically closes upon the fluid being injected into the mixing reservoir. The fluid is contained in the mixing reservoir and mixed with a specimen for a desired amount of time to form a mixture until the blister is selectively collapsed under an externally applied force, at which time the outlet valve member opens to allow the mixture to flow to the detection chamber for analysis.

In accordance with another aspect of the invention, the mixing chamber can contain a reactive substance prior to the injection of the fluid.

In accordance with another aspect of the invention, the specimen and fluid mixture can be injected into the mixing chamber through the mixing chamber inlet valve member.

In accordance with another aspect of the invention, a single mixing chamber can include a plurality of inlets and inlet valve members.

In accordance with another aspect of the invention, the at least one inlet of the mixing chamber can be in fluid communication with an upstream source of fluid via a fluidic channel, wherein the upstream source of fluid can be sealed within a flexible fluid dispensing member.

In accordance with another aspect of the invention, a specimen chamber can be disposed between the mixing chamber and the flexible fluid dispensing member and in fluid communication with the mixing chamber and the fluid dispensing member.

In accordance with another aspect of the invention, the specimen chamber can have a cover movable between an open state and a closed state to allow a specimen to be disposed and sealed within the specimen chamber.

In accordance with another aspect of the invention, a method of performing a diagnostic test is provided. The method includes disposing the specimen in a specimen chamber; injection fluid and/or air through the specimen chamber and causing a mixture including the specimen to flow into a mixing chamber through a one way inlet valve member and simultaneously causing a flexible upper member of the mixing chamber to expand to accommodate the increased volume of matter within the mixing chamber. Then, imparting an external force on the flexible upper member and causing the mixture to flow out of the mixing chamber through a one way outlet valve member to a detection chamber. Then, analyzing the specimen within a detection apparatus.

In accordance with another aspect of the invention, the method can further include disposing a reactive substance with the mixing chamber prior to the injection of the fluid through said at least one inlet.

In accordance with another aspect of the invention, the method can further include providing the mixing chamber with a plurality of the inlets.

In accordance with another aspect of the invention, the method can further include configuring the at least one inlet of the mixing chamber in fluid communication with an upstream source of fluid via a fluidic channel.

In accordance with another aspect of the invention, the method can further include providing the upstream source of fluid as a fluid sealed within a flexible fluid dispensing member on the base.

In accordance with another aspect of the invention, the method can further include configuring a specimen chamber in fluid communication with the mixing chamber and the flexible fluid dispensing member.

In accordance with another aspect of the invention, the method can further include arranging the specimen chamber between the mixing chamber and the fluid dispensing member.

In accordance with another aspect of the invention, the method can further include providing the specimen chamber with a cover movable between an open state and a closed state to allow a specimen to be disposed and sealed within the specimen chamber.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 4:
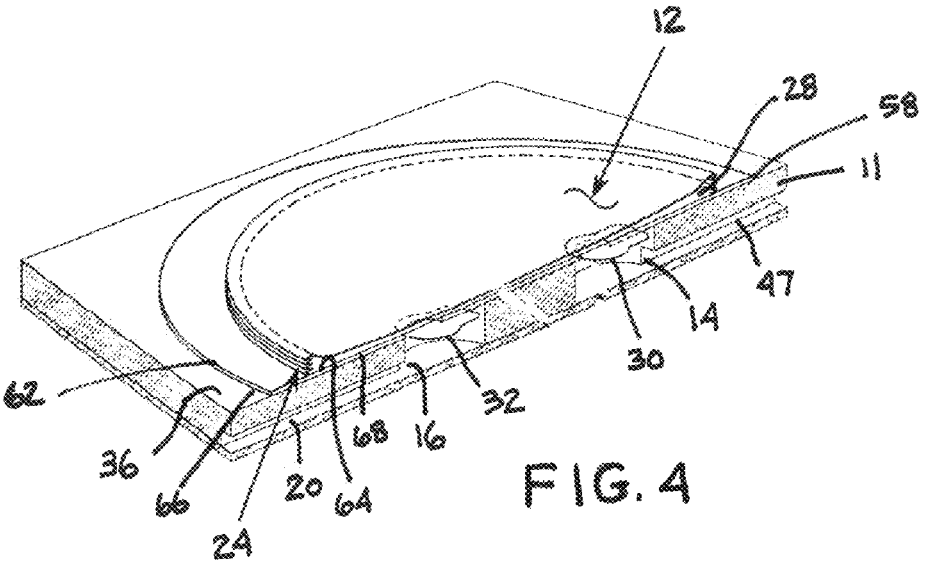
FIG. 4 is an enlarged cross-sectional view of a mixing chamber of the disposable invitro diagnostic cartridge of FIG. 1, with a flexible upper member enclosing the mixing chamber shown in a collapsed state.
Figure 1:
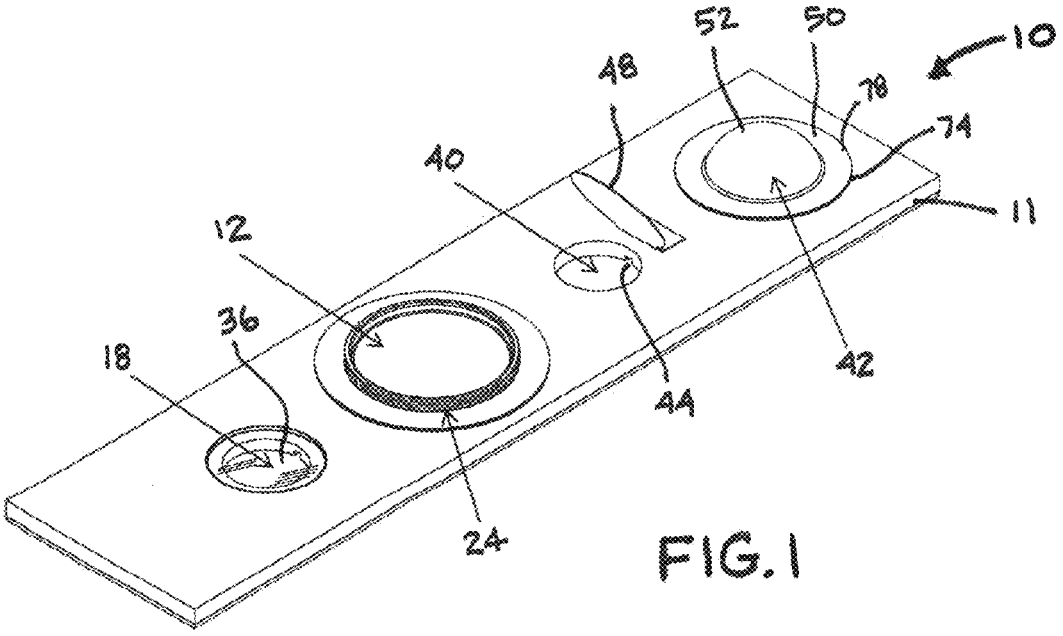
FIG. 1 is a perspective view of a disposable invitro diagnostic cartridge constructed in accordance with one aspect of the invention shown in a pre-actuated state.
Figure 2:
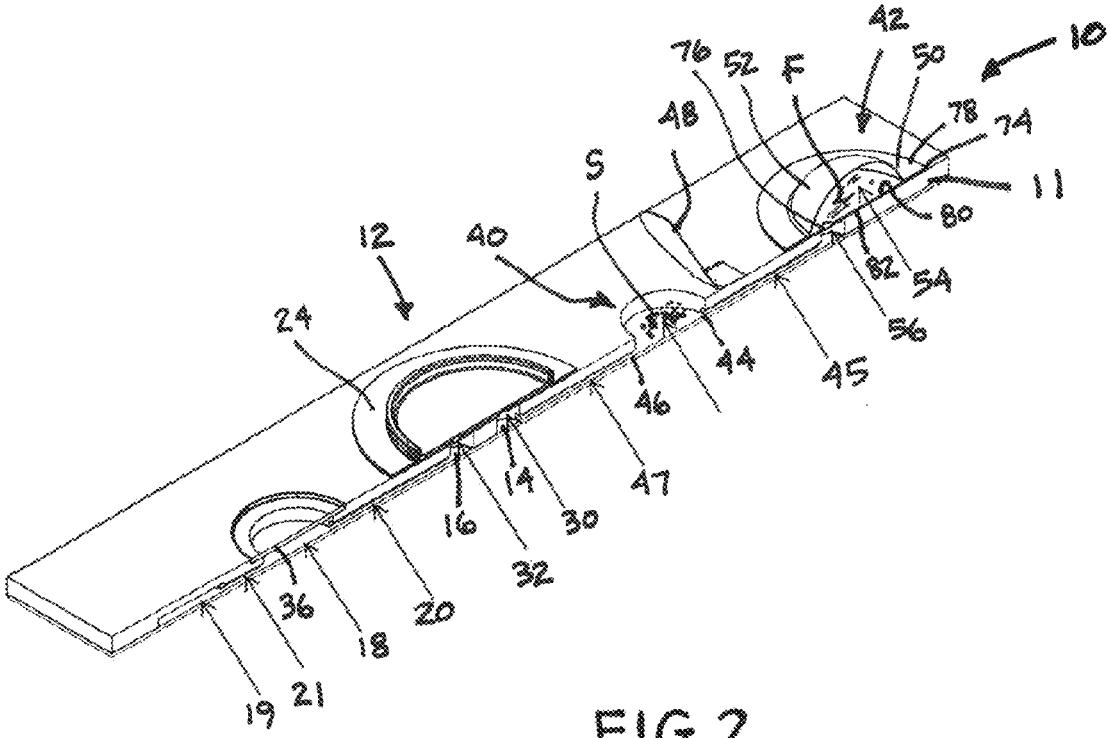
FIG. 2 is a cross-sectional view of the disposable invitro diagnostic cartridge of FIG. 1 shown in a pre-actuated state.
Figure 3:
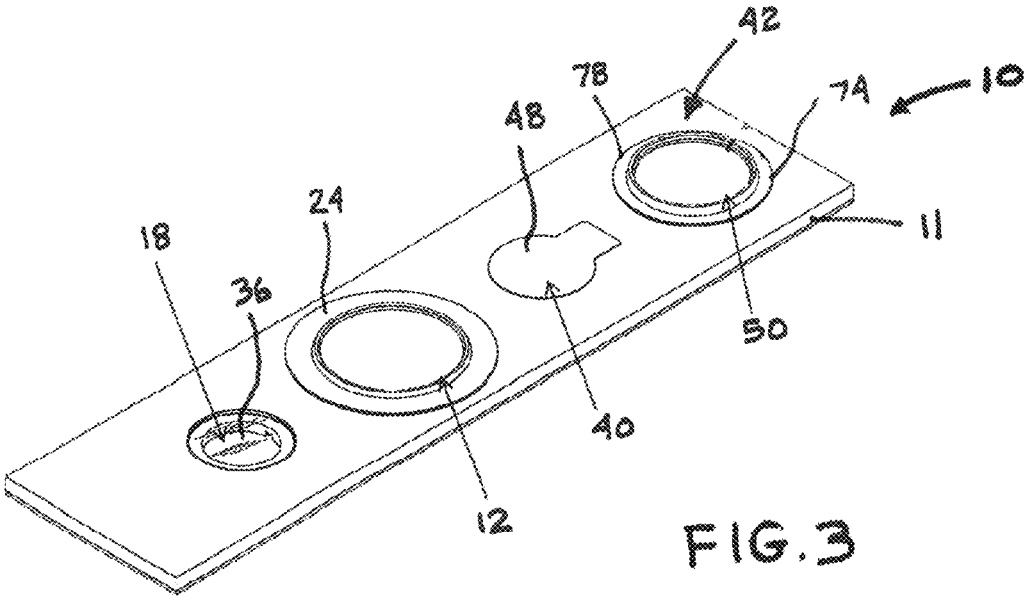
FIG. 3 is a view similar to FIG. 1 showing the disposable invitro diagnostic cartridge in a fully actuated state.

Referring in more to the drawings, FIGS. 1-3 show a disposable invitro diagnostic cartridge constructed in accordance with one aspect of the invention, referred to hereafter as diagnostic cartridge 10, and sometimes referred to in the diagnostic industry as blister card, as well as point-of-care invitro diagnostic device (IVD). The diagnostic cartridge 10 is sized to be hand held and is intended to be disposable after use. The diagnostic cartridge 10 has a rigid or substantially rigid base 11, which can be constructed as a monolithic piece of material or a plurality of material layers bonded to one another, with a mixing chamber 12 formed thereon. The mixing chamber 12 includes at least one mixing chamber inlet 14 and a mixing chamber outlet 16. A detection chamber 18 is formed on the base 11 downstream from the mixing chamber 12, wherein a fluidic channel 20 extends in fluid communication between the mixing chamber 12 and the detection chamber 18 via the mixing chamber outlet 16 and a detection chamber inlet 22. A waste chamber 19 can be provided downstream from the detection chamber 18, if desired, with a further fluidic channel 21 extending in fluid communication therebetween. The mixing chamber 12 includes mixing reservoir 28 bounded at least in part by a flexible upper member 24 operably fixed to the upper surface of the base 11. The flexible upper member 24 is expandable, without being plastically deformed, to increase the volume of the mixing reservoir 28 to a predetermined volume and collapsible to decrease the volume of the mixing reservoir 28. Each mixing chamber inlet 14 has an inlet valve member 30 that provides one way flow of fluid into the mixing reservoir 28 and prevents or substantially prevents fluid from flowing in a reverse direction outwardly from the mixing reservoir 28. The mixing chamber outlet 16 has an outlet valve member 32 that provides one way flow of fluid outwardly from the mixing reservoir 28 to the detection chamber 18 and prevents fluid from flowing in a reverse direction into the mixing reservoir 28. The inlet valve member 30 opens while a supply of fluid F is selectively injected through the mixing chamber inlet 14, thereby causing the flexible upper member 24 to expand from a collapsed state (FIG. 4) and form a raised blister 34 (FIG. 4A), thereby increasing the volume of the mixing reservoir 28, whereupon the inlet valve member 30 automatically closes upon the fluid F being injected into the mixing chamber 12. The fluid F is contained in the mixing reservoir 28 and mixed with a specimen S to form a homogeneous or substantially homogeneous mixture M within the mixing reservoir 28 until the blister 34 is selectively collapsed under an externally applied force via an actuator apparatus 35 (FIG. 4B), at which time the outlet valve member 32 opens to allow the mixture M to flow to the detection chamber 18 for analysis, such as via a diagnostic camera (not shown), through a viewing window 36.

As shown in FIGS. 1-3, in addition to the mixing chamber 12 being in fluid communication with the downstream detection chamber 18, the mixing chamber 12 is also in fluid communication with at least one upstream specimen chamber, shown as a single specimen chamber 40, by way of example and without limitation, and at least one upstream fluid dispensing member, shown as a single fluid dispensing member 42, by way of example and without limitation, with the specimen chamber 40 shown as being between and in fluid communication with the fluid dispensing member 42 via an inlet 44 and fluidic channel 45 and with the mixing chamber 12 via an outlet 46 and a fluidic channel 47. It is to be recognized that the mixing chamber 12 can be in fluid communication with a plurality of specimen chambers and fluid dispensing chambers, such as in a spoke configuration, like spokes on a hub, wherein the hub represents the mixing chamber 12. The specimen chamber 40 is shown as extending into an upper surface 36 of the base 11, by way of example and without limitation. A lid, also referred to as cover 48, is configured to seal off the specimen chamber 40, wherein the cover 48 can be moved from a closed and sealed position (FIG. 3) to an open position (FIGS. 1 and 2). As such, the specimen S, when desired, can be readily disposed into the specimen chamber 40 and sealed therein for testing. The cover 48 can be provided as an impervious flexible film, including a living hinge, or otherwise, such as a relatively rigid impervious member having a mechanical or living hinge, by way of example and without limitation. As such, the cover 48 allows the sample S to be disposed within the specimen chamber 40 and then sealed therein for testing. One possessing ordinary skill in the art will recognize the function of the cover 48 is to allow the specimen S to be disposed into the specimen chamber 40 and sealed therein, and could readily devise other covers than shown, with those covers being contemplated herein.

The fluid dispensing member 42 is shown as having a flexible upper member 50 forming a flexible, raised blister 52 bounding dispensing reservoir 54 of a predetermined volume. The dispensing reservoir 54 contains a predetermined volume of sealed fluid F therein, or it could be air, depending on the nature of the test to be performed, wherein the volume of the dispensing reservoir 54 plus the volume of the specimen chamber 40 is equal or less than the maximum volume of the downstream mixing chamber 12. The fluid F contained in dispensing reservoir 54 can be of any desired type of fluid, again depending on the nature of the test to be performed, including an inactive, non-reactive fluid, such as water, for example, or an active, reactive fluid, such as a reagent capable of lysing a cell. The fluid dispensing member 42 has an outlet valve member 56 that provides one way flow of the fluid F, or air, out of the dispensing reservoir 54 through the fluidic channel 45 to the specimen chamber 40 and through the fluidic channel 47 into the mixing reservoir 28. The outlet valve member 56 prevents or substantially prevents the fluid F, or air, from flowing in a reverse direction back into the dispensing reservoir 54.

The mixing chamber 12 and fluid dispensing member 42 can be constructed separately from the rigid or substantially rigid base 11 and then subsequently attached thereto, or they can be formed on the rigid base 11 in a series of laminations, as will be understood by one ordinarily skilled in the art upon viewing the disclosure herein. For example, the mixing chamber 12 can include a lamination of the upper flexible member 24, a rigid or substantially rigid substrate 58 having a plurality of through openings 57, 59 configured to align with the inlet and outlet valve members 30, 32, respectively, and flexible film materials forming the inlet and outlet valve member 30, 32. The inlet and outlet valve members 30, 32 can be constructed as reed-type valve members, thereby being biased toward their closed positions in the absence of a suitable force causing the valve members 30, 32 to be moved to their open positions. In one example, the inlet valve member 30 can be formed from a piece of impervious, flexible film material having an outer periphery 62 bonded to an upper surface 64 of the rigid substrate 58 and the outlet valve member 32 can be formed from a piece of impervious, flexible film material having an outer periphery 66 bonded to a lower surface 68 of the rigid substrate 58. It should be recognized that if the inlet and outlet valve members 30, 32 are formed from sheets of material having outer peripheries similar in size as the outer periphery of the flexible upper member 24, then the sheet providing the inlet valve member 30 has a through opening configured to register with the through opening 59 in the substrate 58 and the outlet valve member 32 and the sheet providing the outlet valve member 32 has a through opening configured to register with the through opening 57 in the substrate 58 and the inlet valve member 30. Further, if provided as a single sheets of material, the inlet and outlet valve members 30, 32 are preformed therein, such as via a weakened region, such as via die-cut or a stamped, thinned region, sometimes referred to as "kiss-cut", and/or perforated region, for example, wherein each inlet and outlet valve member 30, 32 has a respective living hinge 70, 72.

The fluid dispensing member 42, like the mixing chamber 12, can include a lamination of the upper flexible member 50, a rigid or substantially rigid substrate 74 having a through opening 76 configured to align with the outlet valve member 56 respectively, and flexible film material forming the outlet valve member 56. In contrast to the mixing chamber, however, the fluid dispensing member 42 only has a valve on one side of the substrate 74, namely, the outlet valve member 56. An outer periphery 78 of the upper flexible member 50 is operably bonded via a first adhesive to an upper surface 80 of the substrate 74, wherein the first adhesive provides a sufficient bond to resist delamination over the useful life of the cartridge 10 and the flexible film layer forming the outlet valve member 56 is operably bonded to a lower surface 82 of the substrate 74 via a second adhesive. The second adhesive can be provided to allow selective delamination of the outlet valve member 56 from the lower surface 82 of the substrate 74 during intended actuation.

The material used to form the upper flexible layers 24, 50 is provided as flexible, cold-formable, tough and tear-resistant material. For example, the layers 24, 50 can be formed as a lamination of an outwardly facing material, including foil, such as aluminum, and an inwardly facing, fluid impervious vapor barrier, including a sheet of plastic, such as an oriented polyamide coating (oPA), with an intermediate adhesive, such as a polyvinyl chloride (PVC) or other suitable heat-activated adhesive, bonding the outer and inner laminated layers together. One such material can be purchased from Amcor Flexibles Shelbyville out of Shelbyville, Ky., USA, under the trademark FORMPACK®, under product code 15288, which is incorporated herein by reference. It should be recognized that the aforementioned materials are not plastically deformed during use.

During actuation of the cartridge 10, upon depressing the blister 52 of the fluid dispensing member 42, the outlet valve member 56 is caused to rupture or hingedly open prior to any substantial delamination of the flexible upper member 50 from the substrate 74. Accordingly, the flexible upper member 50 is assured of remaining in a leak-free bond with the substrate 74. Meanwhile, the outlet valve member 56 is assured of opening, as intended, as a result of the relatively weak bond or rupture strength of the valve member 56, whether as a result of a relatively weak material rupture strength and/or a relatively weak rupture strength imparted by intentionally weakened regions within the flexible layer forming the outlet valve member 56 in comparison to the relatively strong material strength of the flexible upper member 50, and also the relatively strong bond strength of the adhesive bonding the flexible upper member 50 operably to the substrate 74.

Figure 4A:
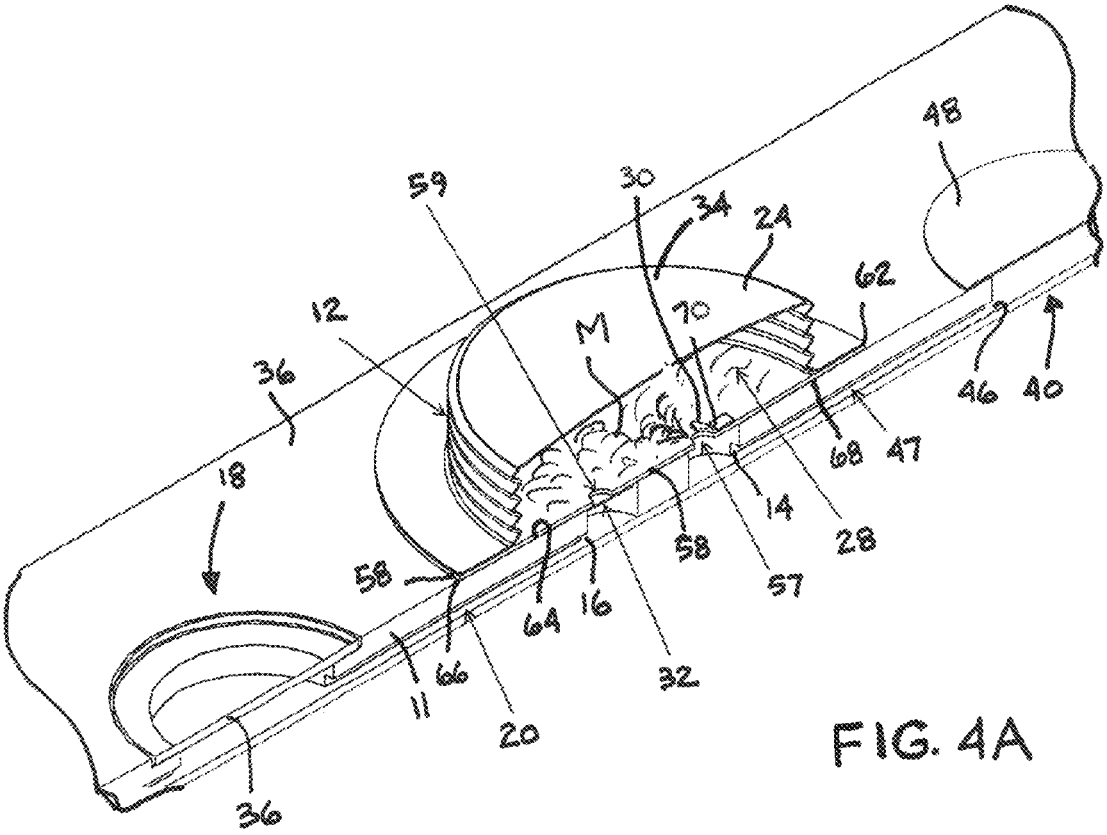
FIG. 4A is an enlarged cross-sectional view of the mixing chamber of the disposable invitro diagnostic cartridge of FIG. 1, with the flexible upper member enclosing the mixing chamber shown in a partially expanded state while receiving a sample and reagent mixture through an inlet valve member.
Figure 4B:
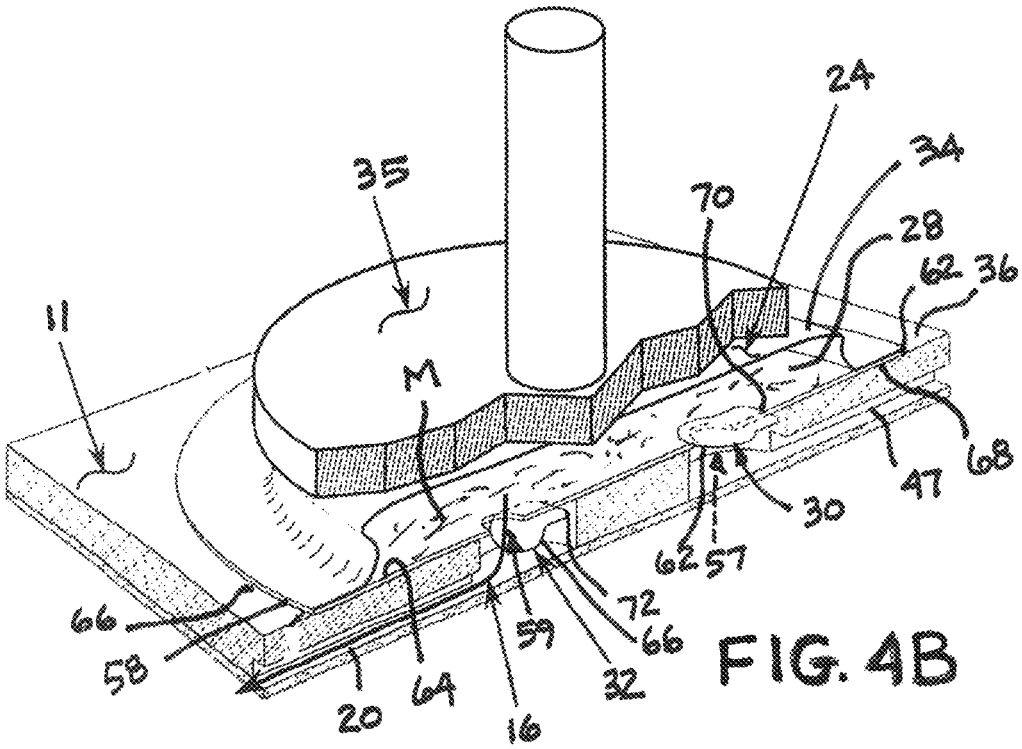
FIG. 4B is a view similar to FIG. 4A showing the flexible upper member being collapsed to dispense the mixture therein through an outlet valve member.

The fluid F flows through the fluidic channel 45 to the specimen chamber 40, whereupon it picks up and mixes with the specimen S to form the mixture M, whereupon the mixture M then flows through the fluidic channel 47 and into the mixing chamber 12 through the inlet 14. Accordingly, the inlet valve member 30 is caused to open temporarily under the pressure of the mixture M, whereupon the flexible upper member 24 is caused to expand from its accordion folded collapsed state to accommodate the presence of the mixture M (FIG. 4A). At this time, with the inlet valve member 30 in its closed state, the mixture M is contained in the mixing reservoir 28 of the mixture chamber 12. When desired, the expanded blister 34 of the mixing chamber 12 is then collapsed under application of an externally applied force, such as via the apparatus 35, thereby causing the outlet valve member 32 to move to its open position (FIG. 4B) to allow the mixture M to flow through the outlet 16 and through the fluidic channel 20 to the detection chamber 18. Then, once in the detection chamber 18, the sample within the mixture M can be analyzed (FIG. 3), with any overage being able to flow to the waste chamber 19 via the fluidic channel 21.

Figure 7:
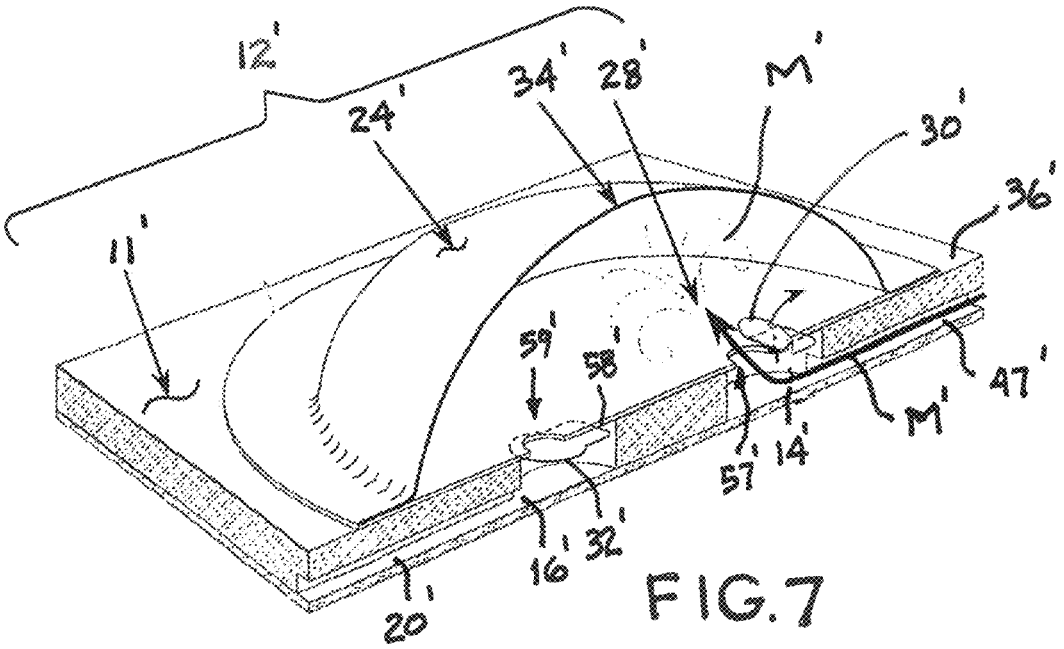
FIG. 7 is a view similar to FIG. 6 showing the flexible upper member being expanded while receiving a sample and reagent mixture through an inlet valve member.
Figure 5:
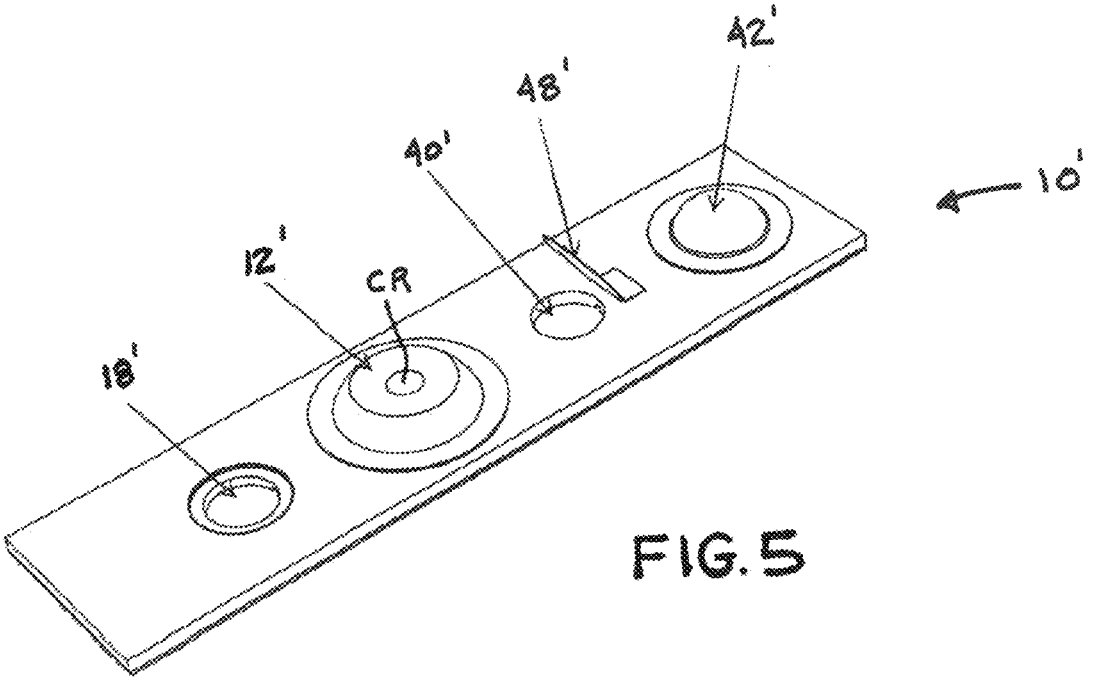
FIG. 5 is a perspective view of a disposable invitro diagnostic cartridge constructed in accordance with another aspect of the invention shown in a pre-actuated state.
Figure 6:
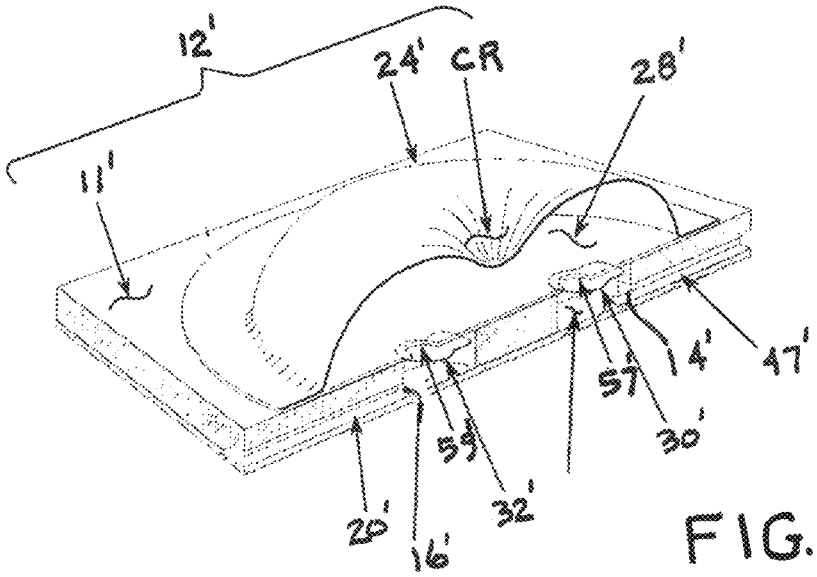
FIG. 6 is an enlarged cross-sectional view of a mixing chamber of the disposable invitro diagnostic cartridge of FIG. 5, with a flexible upper member enclosing the mixing chamber shown in a partially collapsed, pre-mixing state.

FIGS. 5-7 illustrate an embodiment of the cartridge 10' similar to the cartridge 10 described above, wherein the same reference numerals, shown primed, are used to identify like features as described above; however, the manner in which a flexible upper member 24' is initially collapsed is different. Rather than being folded in accordion fashion, a central region CR of the flexible upper member 24' is depressed or dimpled inwardly and bonded lightly to an underlying surface (FIGS. 5 and 6). Then, upon the mixture M' entering the mixing reservoir 28' through the inlet valve member 30', the bond is broken and the flexible upper member 24' is free to expand to accommodate the increased volume of matter (FIG. 7). Otherwise, the cartridge is the same as discussed above for the cartridge 10.

In accordance with another aspect of the invention, a method of performing an invitro diagnostic test on a specimen S is provided. The method includes disposing the specimen S in a specimen chamber 40; injection fluid F and or air through the specimen chamber 40 and causing a mixture M including the specimen S to flow into a mixing chamber 12 through a one way inlet valve member 30 and simultaneously causing a flexible upper member 24 of the mixing chamber 12 to expand to accommodate the increased volume of matter within the mixing chamber 12. Then, imparting an external force on the flexible upper member 24 and causing the mixture M to flow out of the mixing chamber 12 through a one way outlet valve member 32 to a detection chamber 18. Then, analyzing the specimen within the detection chamber 18 through a window 36 via a detection apparatus, such as a detection capable camera, as is known in the art, or other detection device.

Figures 8A, 8B, 8C, 8D, 8E:
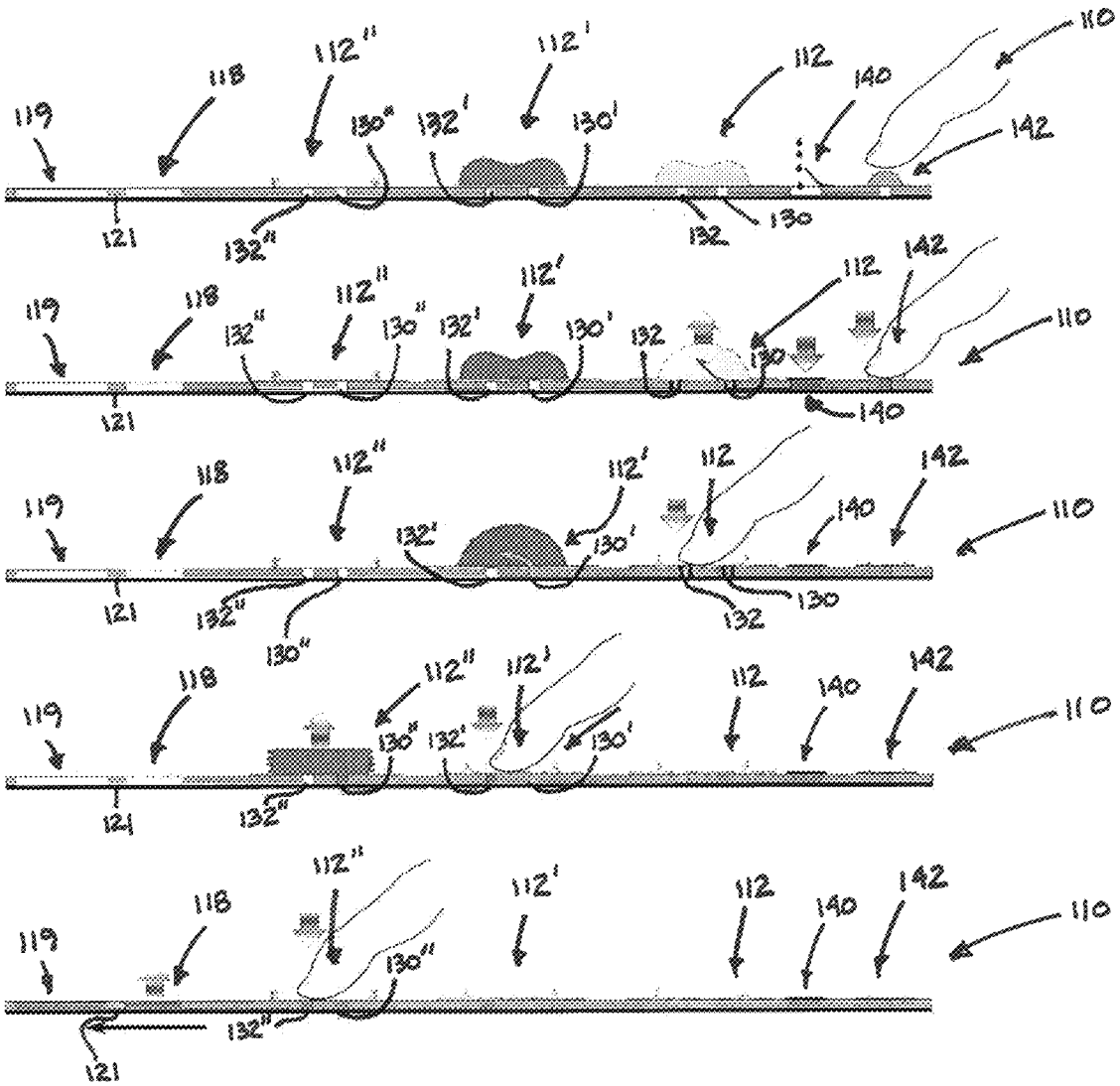
FIGS. 8A-8E illustrate sequential steps used to perform a test using a disposable invitro diagnostic cartridge constructed in accordance with yet another aspect of the invention.

FIGS. 8A-8E illustrate another method of performing an invitro diagnostic test on a specimen and diagnostic cartridge 110 therefore, constructed in accordance with aspect of the invention, wherein the same reference numerals as used above, offset by a factor of 100, are used to identify like features. The cartridge 110 has a fluid and/or air dispensing member 142, constructed similarly as discussed above for the fluid and/or air dispensing member 42, that can be configured in fluid communication with a plurality of downstream mixing chambers 112, 112', 112" with a specimen chamber 140 located between the fluid and/or air dispensing member 142 and the mixing chamber 112. The mixing chambers 112, 112', 112" are constructed similarly as discussed above, each having inlet valve members 130, 130', 130" and outlet valve members 132, 132', 132", and thus, no further discussion is believed necessary to describe their structure or function. Based on this embodiment, it should be recognized that any number of mixing chambers can be integrated into a diagnostic cartridge in accordance with the invention, with the mixing chambers being configured in serial, sometimes referred to as "daisy chain", fluid communication with one another. As shown in FIG. 8A, the specimen is disposed into the specimen chamber 140, whereupon the dispensing member 142 is depressed via an actuator, wherein the fluid from the specimen chamber 140 flows through the specimen chamber 140, picking up the specimen, and carrying the specimen to the first mixing chamber 112. As the fluid and specimen flow through the one-way inlet 130 of the first mixing chamber 112, as shown in FIG. 8B, the flexible upper member of the first mixing chamber 112 expands to accommodate the sudden increase in volume, wherein the fluid, specimen and contents of the first mixing chamber mix together. Then, as shown in FIG. 8C, the flexible upper surface of the first mixing chamber 112 is depressed via an actuator, wherein the mixture flows out of the one-way outlet 132 of the first mixing chamber 112 and through a one-way inlet 130' of a second mixing chamber 112', whereupon the flexible upper member of the second mixing chamber 112' expands to accommodate the sudden increase in volume, wherein the fluid, specimen and contents of the second mixing chamber mix together therein. Then, when desired, as shown in FIG. 8D, the flexible upper surface of the second mixing chamber 112' is depressed via an actuator, wherein the mixture flows out of a one-way outlet 132' of the second mixing chamber 112' and through a one-way inlet 130" of a third mixing chamber 112", whereupon the flexible upper member of the third mixing chamber 112" expands to accommodate the sudden increase in volume, wherein the fluid, specimen and contents of the third mixing chamber, if any, mix together. It should be recognized that the contents of the mixing chambers 112, 112', 112" can contain a mixing medium, fluid or dry substance, or can otherwise remain empty or dry, wherein the mixing medium contained therein is suitably mixed with the fluid that flows through the respective one-way inlets 130, 130', 130". If empty or dry, the mixing chamber is thusly functions to further the mixing of the constituents therein. Then, as shown in FIG. 8E, the flexible upper surface of the third mixing chamber 112" can be depressed, wherein the mixture flows out of a one-way outlet 132" of the third mixing chamber 112" and to a specimen detection chamber 118 for analysis, with excess fluid/gas being able to flow freely through a fluidic channel 121 to a waste chamber 119, as discussed above.

Many modifications and variations of the present invention are possible in light of the above teachings. It is, therefore, to be understood that the invention may be practiced otherwise than as specifically described, and that the scope of the invention is defined by claims allowed.

What is claimed is:

1. A disposable, point-of-care diagnostic cartridge, comprising:

a substantially rigid base having opposite upper and lower surfaces, said base having a mixing chamber with at least one mixing chamber inlet and a mixing chamber outlet, a detection chamber formed downstream from said mixing chamber, said detection chamber having a detection chamber inlet, a fluidic channel extending from said mixing chamber outlet to said detection chamber inlet; and said mixing chamber includes mixing reservoir bounded at least in part by a flexible upper member operably fixed to said upper surface of said base, said flexible upper member being expandable to increase the volume of said mixing reservoir and collapsible to decrease the volume of said mixing reservoir, each said at least one mixing chamber inlet having a one-way inlet valve member that provides one way flow of fluid into said mixing reservoir and prevents fluid from flowing in a reverse direction outwardly from said mixing reservoir, said mixing chamber outlet having a one-way outlet valve member that provides one way flow of fluid outwardly from said mixing reservoir to said detection chamber and prevents fluid from flowing in a reverse direction into said mixing reservoir, said inlet valve member opens while a liquid is selectively injected through said at least one mixing chamber inlet, wherein said flexible upper member expands and forms a raised blister, whereupon said inlet valve member automatically closes upon the fluid being injected into said mixing reservoir, said blister being selectively collapsed under an externally applied force, whereupon said outlet valve member opens to allow the fluid to flow to said detection chamber.

2. The disposable, point-of-care diagnostic cartridge of claim 1 wherein said mixing chamber contains a reactive substance prior to the injection of the fluid through said at least one inlet.

3. The disposable, point-of-care diagnostic cartridge of claim 1 wherein said mixing chamber includes a plurality of said inlets.

4. The disposable, point-of-care diagnostic cartridge of claim 1 wherein said at least one inlet of said mixing chamber is in fluid communication with an upstream source of fluid via a fluidic channel, wherein said upstream source of fluid is sealed within a flexible fluid dispensing member on said base.

5. The disposable, point-of-care diagnostic cartridge of claim 4 further including a specimen chamber in fluid communication with said mixing chamber and said flexible fluid dispensing member.

6. The disposable, point-of-care diagnostic cartridge of claim 5 wherein said specimen chamber is between said mixing chamber and said fluid dispensing member.

7. The disposable, point-of-care diagnostic cartridge of claim 6 wherein said specimen chamber has a cover moveable between an open state and a closed state to allow a specimen to be disposed and sealed within said specimen chamber.

* * * * *